US007972476B2

(12) United States Patent
Scherb et al.

(10) Patent No.: US 7,972,476 B2
(45) **Date of Patent: *Jul. 5, 2011**

(54) METHOD FOR THE PRODUCTION OF TISSUE PAPER

(75) Inventors: Thomas Scherb, Sao Paulo (BR); Luiz Carlos Silva, Camp Limpo (BR); Rogerio Berardi, Sao Paulo (BR); Danilo Oyakawa, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 906 days.

This patent is subject to a terminal disclaimer.

(21) Appl. No.: 11/549,210

(22) Filed: Oct. 13, 2006

(65) Prior Publication Data

US 2007/0119558 A1 May 31, 2007

(30) Foreign Application Priority Data

Oct. 13, 2005 (DE) ..... 10 2005 049 502

(51) Int. Cl.

| | |
|---|---|
| ***D21H 27/00*** | (2006.01) |
| ***D21H 21/14*** | (2006.01) |
| ***D21H 17/28*** | (2006.01) |
| ***D21H 21/18*** | (2006.01) |

(52) U.S. Cl. ..... 162/147; 162/109; 162/117; 162/158; 162/205; 162/164.1; 162/70; 241/21

(58) Field of Classification Search ..... 162/5, 109, 162/115–117, 141, 149, 202–207, 211, 217, 162/70, 147, 158, 164.1, 168.1, 175; 34/397–400, 34/443–444, 452–454, 456, 458–459
See application file for complete search history.

(56) References Cited

U.S. PATENT DOCUMENTS

| | | | | |
|---|---|---|---|---|
| 3,301,745 | A * | 1/1967 | Coppick et al. | 162/55 |
| 3,756,913 | A * | 9/1973 | Wodka | 162/183 |
| 4,718,980 | A * | 1/1988 | Lowrie et al. | 162/78 |
| 4,938,843 | A * | 7/1990 | Lindhal | 162/55 |
| 5,080,758 | A * | 1/1992 | Horng | 162/130 |
| 5,262,007 | A | 11/1993 | Phan et al. | 162/158 |
| 5,409,572 | A | 4/1995 | Kershaw et al. | 162/109 |
| 5,582,681 | A * | 12/1996 | Back et al. | 162/5 |
| 5,638,284 | A * | 6/1997 | Helmer et al. | 700/127 |
| 5,725,732 | A * | 3/1998 | Cooper, III | 162/72 |
| 5,755,926 | A * | 5/1998 | Hankins et al. | 162/6 |
| 5,770,012 | A | 6/1998 | Cooper, III | 162/72 |
| 5,916,417 | A * | 6/1999 | Cassidy et al. | 162/125 |
| 6,001,218 | A * | 12/1999 | Hsu et al. | 162/5 |
| 6,027,610 | A * | 2/2000 | Back et al. | 162/111 |
| 6,068,732 | A * | 5/2000 | Cassidy et al. | 162/123 |
| 6,296,736 | B1 * | 10/2001 | Hsu et al. | 162/147 |
| 6,899,790 | B2 * | 5/2005 | Lee | 162/4 |
| 7,428,786 | B2 * | 9/2008 | Herman et al. | 34/399 |
| 7,527,709 | B2 * | 5/2009 | Lippi Alves Fernandes et al. | 162/358.4 |
| 2002/0060046 | A1 * | 5/2002 | Scherb et al. | 162/358.1 |
| 2003/0136018 | A1 * | 7/2003 | Herman et al. | 34/114 |
| 2005/0145348 | A1 * | 7/2005 | Lee | 162/4 |
| 2006/0118993 | A1 * | 6/2006 | Awofeso et al. | 264/156 |
| 2006/0266487 | A1 * | 11/2006 | Scherb et al. | 162/158 |
| 2007/0029061 | A1 * | 2/2007 | Scherb et al. | 162/289 |
| 2007/0074835 | A1 * | 4/2007 | Scherb et al. | 162/112 |
| 2007/0119558 | A1 * | 5/2007 | Scherb et al. | 162/109 |
| 2007/0240842 | A1 * | 10/2007 | Scherb et al. | 162/205 |
| 2008/0257513 | A1 * | 10/2008 | Scherb et al. | 162/281 |
| 2008/0257514 | A1 * | 10/2008 | Scherb et al. | 162/281 |
| 2009/0205794 | A1 * | 8/2009 | Scherb et al. | 162/28 |

FOREIGN PATENT DOCUMENTS

| | | | |
|---|---|---|---|
| EP | 0 347 153 | | 6/1989 |
| EP | 1775380 | A2 * | 4/2007 |
| WO | WO 97/34047 | | 9/1997 |
| WO | WO 03/062528 | | 1/2003 |
| WO | WO 2005/075736 | | 1/2005 |
| WO | WO 2005/075737 | | 1/2005 |

* cited by examiner

*Primary Examiner* — José A Fortuna
(74) *Attorney, Agent, or Firm* — Taylor IP, P.C.

(57) ABSTRACT

This invention relates to a method for the production of a tissue paper web, which is produced from a pulp suspension having fibers. The method according to the present invention is characterized in that the pulp suspension is formed, at least partly by, a pulp suspension fraction obtained through the treatment of old paper, has a refining degree of less than 30° SR and is of such condition that a laboratory sheet according to TAPPI 205 SP 95 (Rapid Köthen), whose breaking length measured according to TAPPI 220 and TAPPI 494 is 4.0 km or more, is produced therefrom.

78 Claims, 5 Drawing Sheets

PRIOR ART

METHOD FOR THE PRODUCTION OF TISSUE PAPER

BACKGROUND OF THE INVENTION

1. Field of the Invention

The present invention relates to a method for the production of tissue paper and, more particularly to a method for the production of a pulp suspension for use in the production of tissue paper.

2. Description of the Related Art

Tissue paper ideally displays a high absorbency and a high water absorption capacity coupled with a high tear resistance. The absorbency and water absorption capacity are defined essentially by the volume and porosity of the tissue paper. To increase the volume it was already proposed in the prior art in WO 03/062528 to press the tissue paper web during production only on a zone basis in order to obtain only slightly pressed or unpressed voluminous regions and pressed regions of greater tear resistance.

The porosity, the permeability, the absorbency and the dewaterability of the tissue paper are co-defined, essentially by the refining degree of the fibers in the pulp suspension from which the tissue paper is produced. Here a high refining degree gives rise to a high fines content in the suspension, leading to a low porosity and permeability of the produced tissue paper web.

On the other hand the tear resistance is co-influenced by the refining degree of the fibers in the pulp suspension such that the tear resistance is increased by increasing the fines fraction. Hence the requirements imposed on the tear resistance conflict with the previously mentioned requirements imposed on the water absorption capacity, the absorbency and the dewaterability. Further, to save production costs it is desirable to use old paper instead of cellulose, at least in part, in the production of tissue paper.

Experience indicates that a pulp suspension made from treated old paper has a higher refining degree and hence a larger fines fraction, so the opinion in the prior art was that old paper is ill-suited for producing tissue paper, in particular tissue paper with a high water absorption capacity and high absorbency (so-called bulky tissue).

What is needed in the art is a method for the production of a tissue paper web, with which it is possible to produce tear-resistant tissue paper with a high water absorption capacity and absorbency from a pulp suspension with old paper.

SUMMARY OF THE INVENTION

The method of the present invention for producing a tissue paper web from a pulp suspension that includes fibers is characterized in that the pulp suspension is formed at least partly by a pulp suspension fraction obtained from the treatment of old paper. In this case the pulp suspension, directly after the refiner, has a refining degree of less than 30° SR and is of such condition that a laboratory sheet according to TAPPI 205 SP 95 (Rapid Köthen), has a breaking length measured according to TAPPI 220 und TAPPI 494 is 4.0 km or more, can be produced therefrom.

Tests have indicated that, particularly in the case of tissue paper which during its production is more intensively compressed in some regions than in others, sufficient porosity and dewaterability exist when the refining degree of the pulp suspension, which comprises a pulp suspension fraction obtained through the treatment of old paper, is less than 30° SR (Schopper Riegel) directly after the refiner. A sufficient tear resistance of the tissue paper web is provided, as tests have shown, when a laboratory sheet according to TAPPI 205 SP 95 (Rapid Köthen), whose breaking length measured according to TAPPI 220 and TAPPI 494 is 4.0 km or more, can be produced from the pulp suspension.

The laboratory sheet produced according to TAPPI 205 SP 95 (Rapid Köthen) has a gsm substance of 60 g/m$^2$. Also, it has turned out that only a little refining energy is required to produce the pulp suspension with the above mentioned properties for obtaining the required strength values. The pulp suspension fraction obtained through the treatment of old paper can include, in particular, de-inked pulp (DIP).

Tests have shown that the tissue paper can be produced at a high machine speed, meaning 1200 m/min or more, when it is possible to produce, from the pulp suspension, a laboratory sheet according to TAPPI 205 SP 95 (Rapid Köthen) with a breaking length of 4.3 km or more measured according to TAPPI 220 and TAPPI 494. To increase the porosity and dewaterability of the tissue paper web it makes sense for the refining degree of the pulp suspension to be less than 28° SR, in particular less than 25° SR (Schopper Riegel).

To save production costs it makes sense for the fiber fraction of the pulp suspension to be formed to a larger extent by the fibers of the pulp suspension fraction obtained through the treatment of old paper or for the fiber fraction of the pulp suspension to be formed completely by the fibers of the pulp suspension obtained through the treatment of old paper. Preferably the pulp suspension has an ash fraction of less than 4% and/or a fines fraction of less than 25%.

Various possibilities for producing the pulp suspension are conceivable. For example, the pulp suspension can include a suspension fraction, which was produced from a low-consistency feed pulp suspension obtained through the treatment of old paper, whereby the low-consistency feed pulp suspension has a consistency of less than 5%.

To produce the inventive pulp suspension from the low-consistency feed pulp suspension the latter is refined at the low consistency of less than 10%, for example. In this case it is a disadvantage that a large fines fraction is often produced as the result of refining the feed pulp suspension at low consistency in order to produce a sufficient tear resistance. Tests conducted by the Applicant have indicated that the refinement can be significantly reduced if enzymes and/or agents for increasing the dry strength, so-called "Dry Strength Agents" (DSAs), and/or agents for increasing the wet strength, so-called "Wet Strength Agents" (WSAs) are added to the low-consistency feed pulp suspension. In such a case it is even possible, in the ideal case, to dispense completely with refining.

By adding DSAs it is possible to reduce further the refining degree in the pulp suspension while retaining the tear resistance. Carbon methyl cellulose and/or starch, for example, can be used as DSA. As WSA it is possible to use, for example, a product with the trade-name Kymene®, which is a water-soluble polymer that provides wet strength to paper, which is marketed by the Hercules Company.

It has proven advantageous for the enzymes to be added to the low-consistency feed pulp suspension at a temperature in the range from 25° C. to 70° C., preferably 30° C. to 60° C., in particular preferably around 35° C. to 45° C., as their effectiveness is highest in this temperature range. The effectiveness of the enzymes is increased by adding them to the low-consistency feed pulp suspension with a pH-value in the range from 5 to 8, preferably 5.5 to 7.5, in particular preferably around 6.5 to 7. Good results are obtained when the enzymes are allowed to work for a period of 1-2 hours, preferably 1.5 hours, on the low-consistency feed suspension. The enzymes can be added to the feed pulp suspension in the pulper prior to the refining pass.

The inventive pulp suspension can also include a suspension fraction, which was produced from a high-consistency feed pulp suspension with a consistency of 20% or more, preferably 20% to 40%, in particular preferably 25% to 35%. In the production of the pulp suspension the high-consistency feed pulp suspension is refined at the high consistency stipulated above. The high-consistency feed pulp suspension can be obtained through concentration of a low-consistency feed suspension, whereby the concentrating can be performed by way of a worm extruder. To obtain the required strength the refining operation can be performed several times in succession.

The best results, with regard to the strength obtained with a low refining degree, are obtained when the high-consistency feed pulp suspension is refined with a refining energy in the range from 150 kWh to 300 kWh, in particular 180 kWh to 250 kWh per ton. To establish the above mentioned advantageous properties of the pulp suspension it also makes sense for the high-consistency feed pulp suspension to be refined at a temperature in the range of between 20° C. and 80° C., preferably at 40° C.

The above described addition of enzymes brings advantageous results for the present invention if they are added to the high-consistency feed pulp suspension. It is possible not only for the pulp suspension to be provided from a suspension produced from a high-consistency feed pulp suspension, but also for this suspension fraction (first suspension fraction) to be mixed with a suspension fraction (second suspension fraction) produced from a low-consistency feed pulp suspension with a consistency of less than 10% in order to produce the pulp suspension. In this case, the second suspension fraction preferably has a higher refining degree than the first suspension fraction.

Tests have shown that the tissue paper web can be effectively dewatered during its production in order to obtain a satisfactory dry content when the fibers of the pulp suspension have a water retention value of 1.5 g/g or less, preferably 1.4 g/g measured according to TAPPI UM 256.

The method according to the present invention is then particularly effective with regard to increasing the dewaterability during production and the water absorption capacity and absorbency of the finished product at a satisfactory level of tear resistance if, during its production, the tissue paper web is less intensively compressed in some regions than in others. In particular the tissue paper web is not compressed at all in these regions. If the tissue paper web is to have regions compressed with various intensities, it makes sense for the tissue paper web to be formed already from the pulp suspension on a structured, in particular a 3-dimensionally structured mesh. On such a structured mesh the side facing the tissue paper web has, at least in some areas, depressed regions and, relative to the depressed areas, raised regions. The tissue paper web is formed in areas that are depressed and raised regions of the structured mesh. The areas of the tissue paper web formed in the depressed regions of the structured mesh have a higher volume and gsm substance than the areas formed in the raised regions of the mesh. A 3-dimensional tissue paper web is formed as the result. Here the tissue paper web has voluminous pillow areas with a high gsm substance formed in the depressed regions of the structured mesh and less voluminous areas formed in the raised regions of the mesh.

The structured mesh can include a Through Air Drying (TAD) mesh or a Dimensionally Structured Paper (DSP) mesh. The advantage of a TAD mesh is its high permeability, thus guaranteeing quick dewatering during the forming operation. With regard to the structure of the structured mesh and with regard to the formation of the tissue paper web on the structured mesh, reference is made to PCT/EP2005/050203, which herewith is included in full and made part of this application.

After the formation of the tissue paper web, the tissue paper web is conveyed, preferably in a dewatering step, between an upper structured, in particular 3-dimensionally structured, and permeable skin and a lower permeable skin. Pressure is exerted on the upper skin, the tissue paper web and the lower skin during the dewatering step along a dewatering section. The pressure exerted on the arrangement of an upper structured and permeable skin, tissue paper web and lower permeable skin can be generated by a gas flow. In addition or alternatively to this, the pressure exerted can be generated by a mechanical pressing force.

To compress the tissue paper web only in some regions by the application of pressure and thus produce a tissue paper with a high volume for good absorbency in some regions, in the unpressed or less pressed regions, and with high strength in other regions, in the more intensively pressed regions, it makes sense for the side of the structured skin facing the tissue paper web to include depressed regions and raised regions relative to the depressed regions. Consequently, as previously mentioned, the tissue paper web is compressed less intensively, in particular not at all, in the depressed regions than in the raised regions.

The upper structured and permeable skin is preferably a structured mesh, in particular a TAD mesh or DSP mesh, and the lower permeable skin is preferably a felt having a sufficiently high water absorption capacity for the water, which is pressed out of the tissue paper web. With regard to the structure of the lower skin, reference is made to PCT/EP2005/050198, which herewith is included in full and made a part of this application.

The compressibility (change of thickness in mm upon application of force in N) of the upper skin is preferably smaller than the compressibility of the lower skin. The voluminous structure of the tissue paper web, upon the application of pressure, is thus retained. Tests have shown that a particularly good and gentle dewatering is possible when the dynamic rigidity (K), as a measure for the compressibility of the upper skin, is 3000 N/mm or more.

Given a hard or very hard lower skin, the voluminous pillow areas of the tissue paper web would not be compressed at all. Thanks to the compressible structure of the lower skin the voluminous pillow areas of the tissue paper are slightly pressed and hence gently dewatered. Tests in this connection have shown that the dynamic rigidity (K), as a measure for the compressibility of the lower skin, is 100,000 N/mm or less, preferably 90,000 N/mm, in particular preferably 70,000 N/mm or less. Similarly it is an advantage for the shear modulus or G modulus, as a measure for the elasticity of the lower skin, to be 2 $N/mm^2$ or more, preferably 4 $N/mm^2$ or more.

Additionally, tests have shown that the water stored in the lower skin, for example felt, can be expelled more easily with a gas flow when the permeability of the lower skin is not too high. It proves to be an advantage when the permeability of the lower skin is 80 cfm or less, preferably 40 cfm or less, in particular preferably 25 cfm or less. In the above mentioned regions the rewetting of the tissue paper web by the lower skin is largely prevented.

In the dewatering step, preferably the upper skin is first charged with gas, then the tissue paper web and finally the lower skin. The dewatering of the paper web takes place in this case in the direction of the lower skin.

Optionally, or in addition, to gas charging of the above mentioned arrangement provision can be made for the arrangement of the upper skin, the tissue paper web and the lower skin to be conveyed during the dewatering step, at least in some areas along the dewatering section, between a tensioned press belt and a smooth surface, whereby the press belt acts on the upper skin, and the lower skin rests on the smooth surface. In this case the dewatering of the paper web takes place in the direction of the lower skin.

The arrangement of the upper skin, the tissue paper web and the lower skin is preferably charged with the gas flow, at least in some areas, in the region of the dewatering section so that the dewatering takes place simultaneously by the pressing force of the press belt and the through-flow of gas. Tests have shown that the gas flow through the tissue paper web amounts to approx. 150 $m^3$ per minute and meter length along the dewatering section.

Here the gas flow can be generated by a suction zone in a roller. In this case the suction zone has a length in the range between 200 mm and 2,500 mm, preferably between 800 mm and 1,800 mm, and in particular preferably between 1,200 mm and 1,600 mm. The vacuum in the suction zone amounts to between 0.2 bar and 0.8 bar, preferably between 0.4 bar and 0.6 bar. Optionally, or in addition, to this, the gas flow can also be generated by an excess pressure hood arranged above the top skin. The excess pressure hood can be a steam blower box, for example. In the latter, case the temperature of the gas flow amounts to between 50° C. and 180° C., preferably between 120° C. and 150° C., and the excess pressure amounts to less than 0.2 bar, preferably less than 0.1 bar and in particular preferably less than 0.05 bar. The gas can be hot air or steam.

The pressing force on the tissue paper web can be increased by a high tension of the press belt. Tests have shown that sufficient dewatering, particularly of the non-voluminous areas of the tissue paper, is obtained when the press belt is under a tension of at least 30 kN/m, preferably at least 60 kN/m or 80 kN/m. The press belt can have a spiralized structure and be constructed as a so-called spiral link fabric. Furthermore, it is possible for the press belt to have a woven structure.

To be able to obtain a good dewatering of the tissue paper web by the mechanical tensioning of the press belt and as the result of the gas flow through the press belt the press belt has an open area of at least 25% and a contact area of at least 10% of its total area facing the upper skin. A uniform mechanical pressure is exerted on the arrangement of structured upper skin and lower skin by increasing the contact area of the press belt.

Satisfactory results are obtained with all the values stipulated below for the contact area and open area of the press belt.

Provision is made accordingly for the press belt to have an open area of between 75% and 85% and a contact area of between 15% and 25% of its total area facing the upper skin. Provision is also made for the press belt to have an open area of between 68% and 76% and a contact area of between 24% and 32% of its total area facing the upper skin. Very good results with regard to dry content and voluminosity of the tissue paper are obtained when the press belt has an open area of between 51% and 62% and a contact area of between 38% and 49% of its total area facing the upper skin. In particular through the construction of the press belt with a woven structure it is possible for the press belt to have an open area of 50% or more and a contact area of 50% or more of its total area facing the upper skin. As such it is possible to provide for a good gas flow through the press belt as well as a homogeneous pressing force by way of the press belt.

The smooth surface is formed preferably by the circumferential surface of a roller.

Through the above described dewatering operation it is possible for the tissue paper web to leave the dewatering section with a dry content of between 25% and 55%.

To ensure that the voluminous areas of the tissue paper are only slightly pressed during the dewatering step the structured mesh in the dewatering step has the same mesh as in the formation of the tissue paper web. As the result, the voluminous pillow areas of the tissue paper web remain in the depressed regions of the structured mesh during application of the pressure such that the voluminous areas are largely protected against the application of pressure and far less pressure is exerted on these areas than on the areas of the tissue paper web lying in between. The voluminous structure of the pillow areas is thus retained during the dewatering step.

After the dewatering step the tissue paper web is conveyed together with the structured skin of the dewatering step through a press nip in a further dewatering step and is dewatered further thereby.

Furthermore, the tissue paper web in the press nip is arranged between the structured and permeable upper skin and a smooth and heated roller surface, in which case the heated and smooth surface is formed by the circumferential surface of a Yankee drying cylinder.

Transporting the tissue paper web on the structured upper skin through the press nip ensures that, during the dewatering step, the voluminous pillow areas of the tissue paper are less intensively pressed than the areas lying in between. The depressed, and by comparison relatively raised areas, of the structured and permeable skin are constructed and arranged in relation to each other such that only 35% or less, in particular only 25% or less of the tissue paper web is pressed in the press nip.

If, as previously mentioned, the structured upper skin is the same structured skin as that on which the tissue paper was formed, then the 3-dimensional structure of the tissue paper is created already during the formation. By contrast, with the method according to the prior art the 3-dimensional structure of the tissue paper is not formed until during a subsequent dewatering step by the tissue paper web being pressed into a structured mesh, thus forming an essentially two-sided corrugated tissue paper.

With the method according to the present invention, the formation of the tissue paper between the structured skin and a forming mesh with a relatively smooth surface forms a tissue paper web which is essentially smooth on the side which was formed on the smooth forming mesh. On passing through the press nip this side comes into contact with the circumferential surface of the Yankee drying cylinder, in which case the relatively large contact area, compared to the prior art, prevents the tissue paper web from burning at the high temperatures of the Yankee drying cylinder. As the result, the temperature of the Yankee drying cylinder can be raised compared to the prior art, leading to a higher dry content of the tissue paper web produced.

In the interest of gentle pressing in the press nip the press nip has an elongated press nip, meaning that it is formed by the roller surface and a shoe press unit. If the aim is to increase the dry content, which occurs at the expense of the voluminosity of the produced tissue paper web, then provision can be also be made for the press nip to be formed by a suction press roller and the roller surface instead of by the shoe press unit and the roller surface.

To remove water, which is carried in the structured upper skin and which obstructs dewatering in the press nip, the tissue paper web is conveyed together with the structured skin around an evacuated deflector roller, whereby the structured skin is arranged between the tissue paper web and the evacuated deflector roller.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
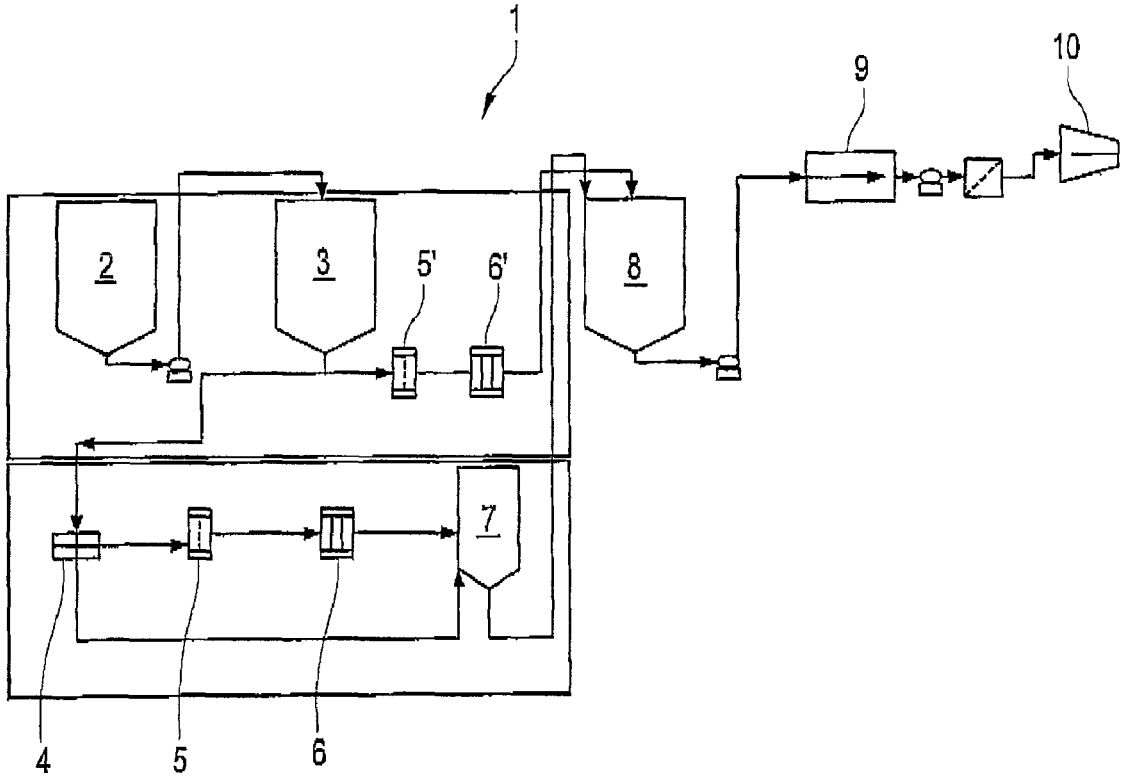
FIG. 1 shows an apparatus for the production of a pulp suspension according to one embodiment of the present invention.

Referring now to the drawings, and, more particularly to FIG. 1 there is shown an apparatus 1 for providing according to the present invention a pulp suspension which is subsequently used in the method for the production of a tissue paper web. Apparatus 1 includes a pulper 2 in which a feed pulp suspension obtained through the treatment of old paper exists in a pumpable state. The feed pulp suspension is conveyed from the pulper 2 to a mixing chest 3. At this stage the pulp has a consistency of less than 10%, i.e. as a rule 5% or less, and in this connection is referred to as low-consistency feed pulp.

In one embodiment the low-consistency feed pulp is conveyed to a concentrator 4, which can be constructed as a worm extruder for example, and is concentrated therein from a consistency of 5% to a consistency of 25% to 35% ideally around 30%, thus producing a high-consistency feed pulp suspension.

The high-consistency feed pulp suspension thus formed is subjected to a refining process. For this purpose the high-consistency feed pulp suspension is heated in a heating channel 5 to a temperature up to 80° C., ideally around 40° C., and then conveyed to a refiner 6 for refining. During the refining operation the high-consistency feed pulp suspension is refined to a refining degree of less than 30° SR, ideally less than 25° SR.

To obtain the high-consistency pulp suspension, the high-consistency feed pulp suspension is refined with a total refining energy in the range from 150 kWh to 300 kWh, in particular 180 kWh to 250 kWh per ton. The refining operation can be performed in one step or in several refining steps in succession.

Enzymes and agents for increasing the dry strength (DSAs) and/or agents for increasing the wet strength (WSAs) can be added to the pulp prior to the refining operation, for example in pulper 2.

Here it proves to be particularly advantageous with regard to the desired properties of the subsequently formed tissue paper web in terms of its porosity and permeability coupled with high tear resistance for the enzymes to be added to the low-consistency feed pulp suspension at a temperature in the range from 25° C. to 70° C., preferably 30° C. to 60° C., in particular preferably around 35° C. to 45° C. The low-consistency feed suspension has a pH-value in the range from 5 to 8, preferably 5.5 to 7.5, in particular preferably around 6.5 to 7, and the enzymes are allowed to work on the low-consistency feed suspension for 1-2 hours, preferably 1.5 hours.

The pulp suspension, obtained from the high-consistency refining operation, is then diluted in a dilution tank 7 with water, which is obtained at least in part during concentration of the low-consistency feed pulp suspension in concentrator 4. The re-diluted pulp thus obtained is then conveyed to a stock chest 8.

In the case of many low-consistency feed pulp suspensions it is possible, with no or only a little refining, to achieve a sufficient strength if enzymes and/or agents for increasing the dry strength (DSAs) and/or agents for increasing the wet strength (WSAs) are added to them. Transforming such a low-consistency feed pulp suspension, with a consistency of less than 5%, into a high-consistency feed pulp suspension through concentration is unnecessary in this case. For slight refining, such a low-consistency feed pulp suspension is fed directly to a heating channel 5' and then to a refiner 6' for refinement. The low-consistency pulp suspension thus obtained can then be conveyed to a stock chest 8.

In stock chest 8 the pulp suspension obtained by way of the high-consistency refining operation is mixed with the low-consistency suspension.

Furthermore it is also conceivable for the low-consistency feed pulp to have a high strength such that the pulp suspension includes only one pulp suspension fraction, which was produced by way of adding enzymes and performing a refining operation or only by way of adding enzymes at a low consistency. Downstream from stock chest 8 the pulp suspension is greatly diluted with mesh water 9 and conveyed to a headbox 10.

Regardless of how the pulp suspension is received, it is important for the production of tissue paper that the pulp suspension emerging from the headbox 10 and including an old paper fraction has, directly after refiner 6 and 6', a refining degree of less than 30° SR and is of such condition that a laboratory sheet according to TAPPI 205 SP 95 (Rapid Köthen), whose breaking length measured according to TAPPI 220 und TAPPI 494 is 4.0 km or more, can be produced therefrom.

Figure 7:
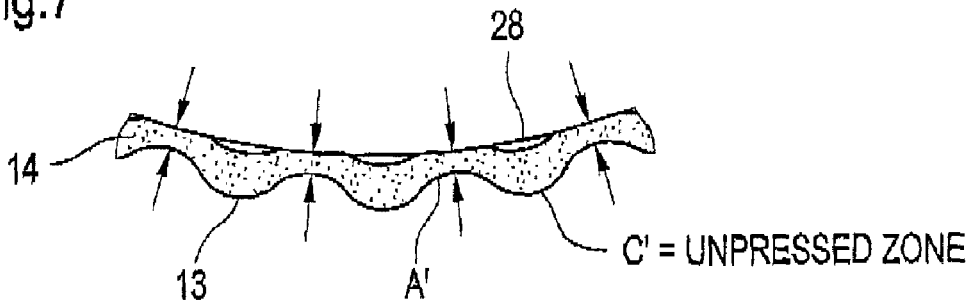
PRIOR ART Fig.7
FIG. 7 shows the structure of a tissue paper web upon its dewatering in the press nip with the method according to the present invention.
Figure 8:
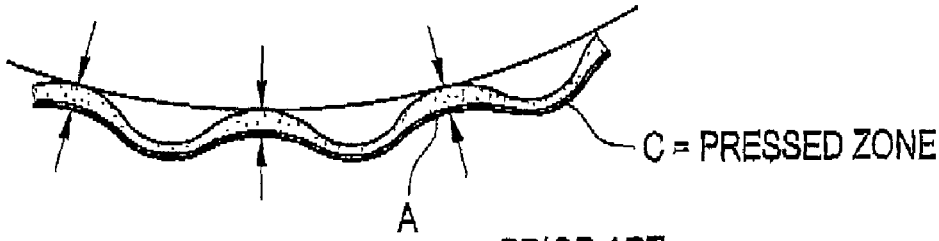
FIG. 8 shows the structure of a tissue paper web upon its dewatering with one of the known methods according to the prior art.
Figure 9:
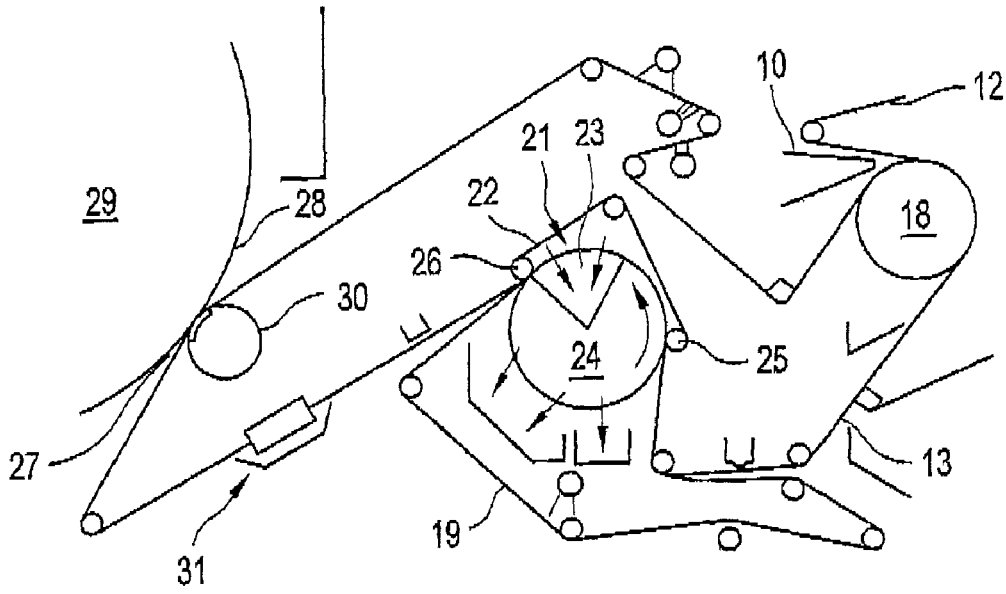
FIG. 9 shows a first apparatus for performing the method according to the present invention.
Figure 10:
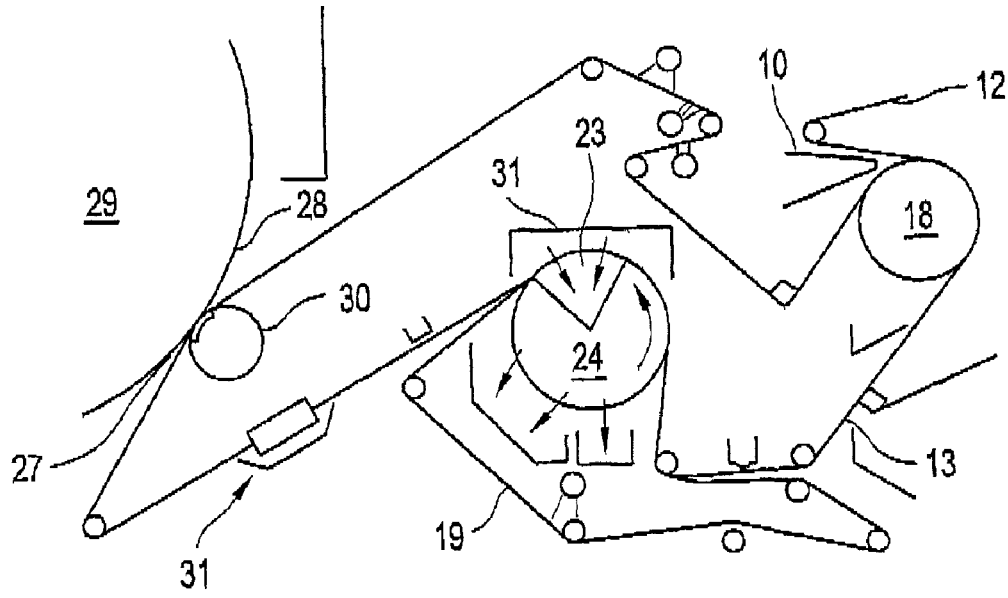
FIG. 10 shows a second apparatus for performing the method according to the present invention.

The procedure is now further explained referring to FIGS. 2-10, with FIGS. 9 and 10 presenting two embodiments of different apparatuses for performing the method of the present invention.

A pulp suspension 11, with the above mentioned properties, emerges from headbox 10 such that the suspension is injected into the ingoing nip between a forming mesh 12 and a structured, in particular 3-dimensionally structured mesh 13, as the result of which a tissue paper web 14 is formed. Forming mesh 12 has a side facing tissue paper web 14, which is relatively smooth compared to that of structured mesh 13.

Side 15 of structured mesh 13 facing tissue paper web 14 has depressed regions 16 and, relative to depressed areas 16, raised regions 17 such that tissue paper web 14 is formed in depressed regions 16 and raised regions 17 of structured mesh 13. The difference in height between depressed regions 16 and raised regions 17 amounts to between preferably 0.07 mm and 0.6 mm. The area formed by raised regions 16 amounts to preferably 10% or more, in particular preferably 20% or more and in particular preferably 25% to 30%. In the embodiment presented in FIG. 3 structured mesh 13 is shown as a TAD mesh 13.

Figure 2:
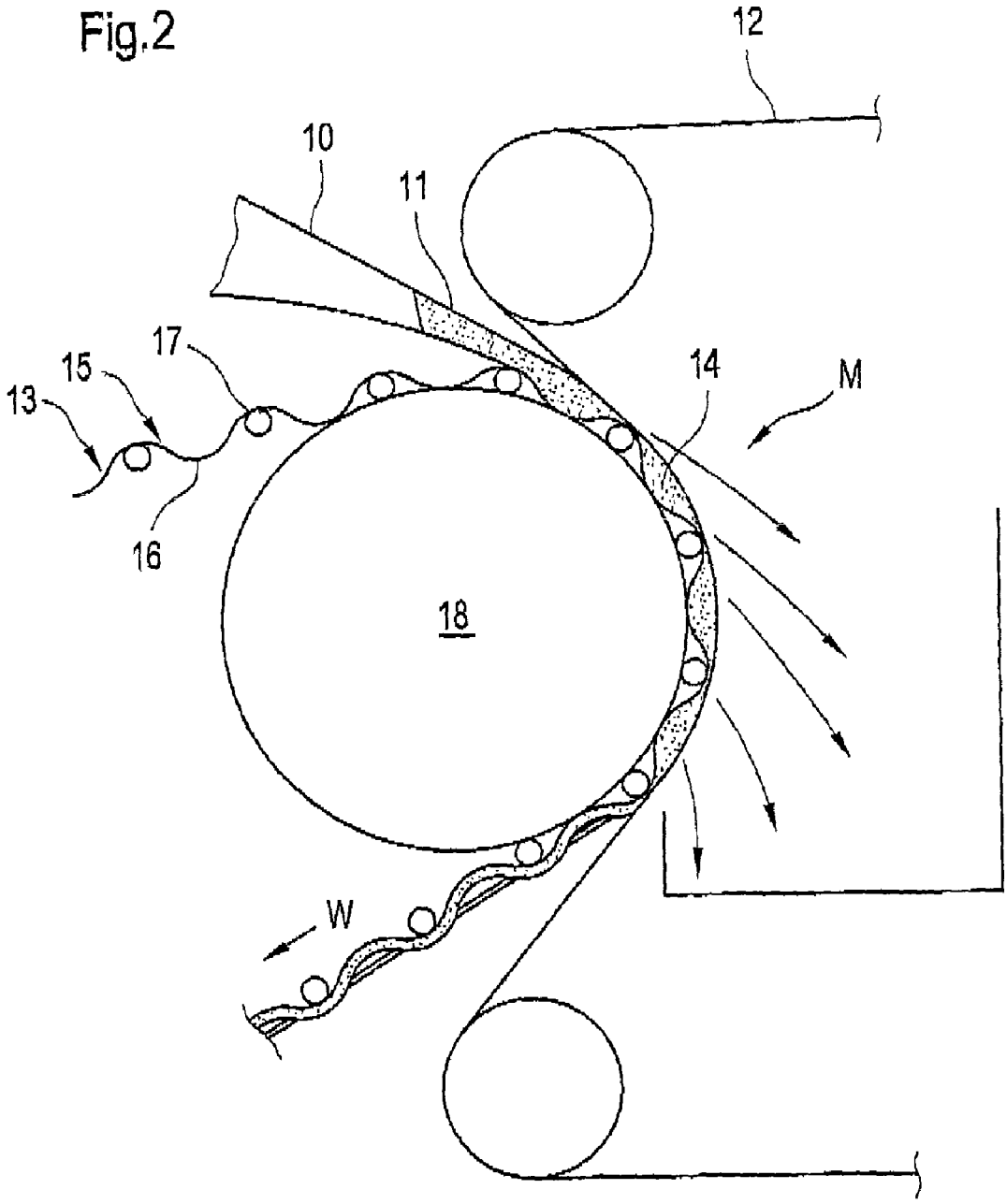
FIG. 2 shows a partial representation of an apparatus for performing the method according to the present invention for the production of tissue paper.

In the embodiment presented in FIG. 2 the arrangement of TAD mesh 13, tissue paper web 14 and forming mesh 12 are directed around a forming roller 18 and tissue paper web 14 is dewatered essentially by forming mesh 12 before forming mesh 12 is taken off tissue paper web 14 and tissue paper web 14 is transported further on TAD mesh 13.

Figure 3:
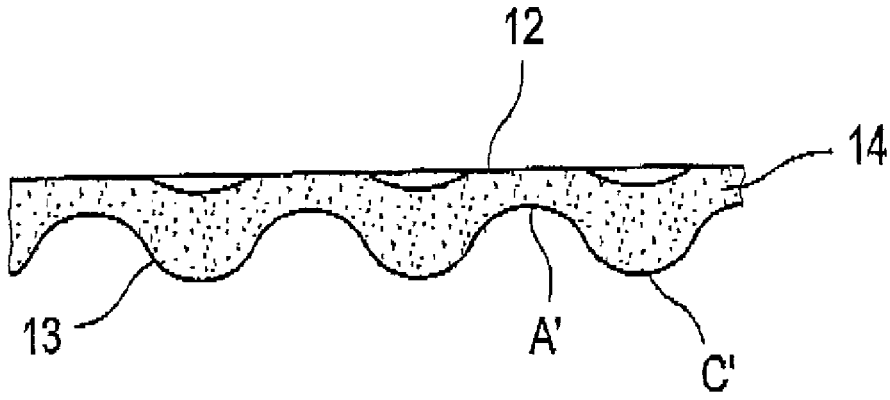
FIG. 3 shows the structure of a tissue paper web upon its formation with the method according to the present invention.

Evident in FIG. 3 is the structure of tissue paper web 14 formed between flat forming mesh 12 and TAD mesh 13. Voluminous pillow areas C' of tissue paper web 14 formed in depressed regions 16 of TAD mesh 13 have a higher volume and a higher gsm substance than areas A' of tissue paper web 14 formed in raised regions 17 of TAD mesh 13. Accordingly, tissue paper web 14 already has a 3-dimensional structure as the result of its forming on structured mesh 13.

Figure 4:
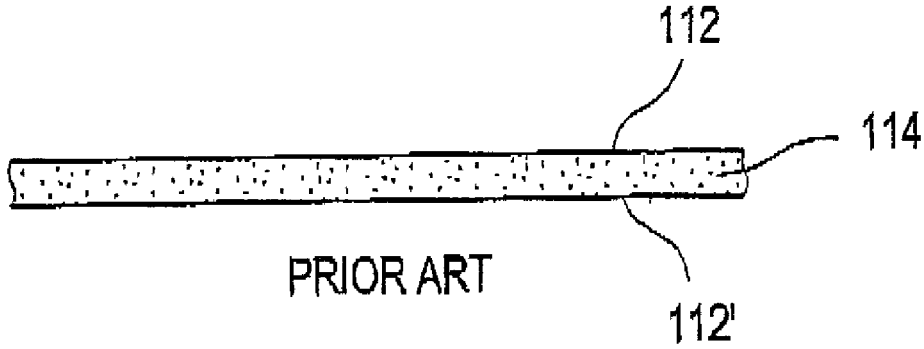
FIG. 4 shows the structure of a tissue paper web upon its formation with a known method according to the prior art.

Evident in FIG. 4 is a tissue paper web 114 which was formed between two flat forming meshes 112 and 112'. As the result of its forming between two smooth forming meshes 112 and 112', tissue paper web 114 has an essentially smooth and non-3-dimensional structure.

Figure 5:
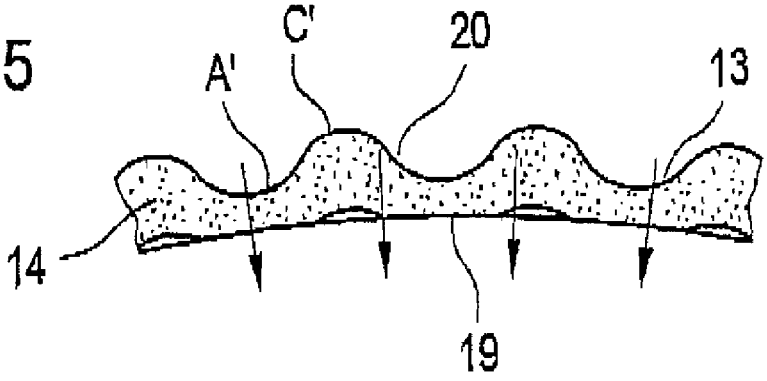
FIG. 5 shows the structure of a tissue paper web upon its dewatering with the method according to the present invention.

In a dewatering step, after the formation of tissue web 14, tissue paper web 14 is conveyed between structured mesh 13, which is arranged above, and a lower permeable skin 19, which is constructed as felt 19, whereby during the dewatering step along a dewatering section, pressure is exerted on structured mesh 13, tissue paper web 14 and felt 19 such that tissue paper web 14 is dewatered in the direction of felt 19, as indicated by arrows 20 in FIG. 5. As the result of tissue paper web 14 being dewatered during this dewatering step in the direction of felt 19 and as the result of tissue paper web 14 being dewatered on structured mesh 13 on which it was previously formed, voluminous areas C' are less intensively compressed than areas A', thus resulting in the voluminous structure of areas C' being preserved.

Figure 6:
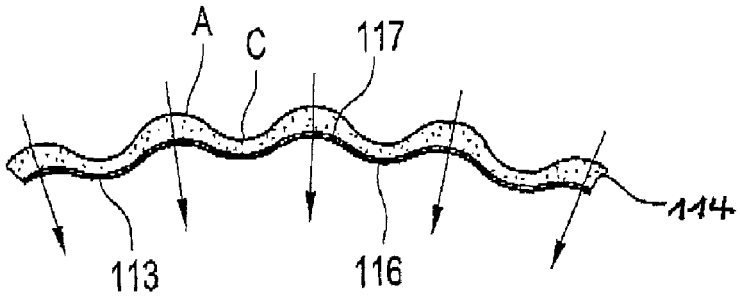
FIG. 6 shows the structure of a tissue paper web upon its 3-dimensional structuring with a known method according to the prior art.

Evident in FIG. 6 is the creation of a 3-dimensional structure of the tissue paper web 114 formed in FIG. 5. To create the 3-dimensional structure, the tissue paper web 114 must be pressed into a structured mesh 113. For this purpose tissue paper web 114 in areas C, which are pressed into depressed regions 116 of structured mesh 113, are stretched, as the result of which the gsm substance in areas C is reduced. Also, tissue paper web 114 in areas C is intensively pressed, as the result of which the volume of areas C is reduced as well.

The pressure for dewatering tissue paper web 14 is generated during the dewatering step at least in some areas simultaneously by a gas flow and a mechanical pressing force.

Here the gas flow passes first through the structured mesh, then the tissue paper web 14 and finally the lower skin constructed as felt 19. The gas flow through tissue paper web 14 amounts to around 150 $m^3$ per minute and meter web length. The gas flow is generated by a suction zone 25 in roller 24. Suction zone 25 has a length in the region of between 200 mm and 2,500 mm, preferably between 800 mm and 1,800 mm, and in particular preferably between 1,200 mm and 1,600 mm. The vacuum in suction zone 25 amounts to between −0.2 bar and −0.8 bar, and preferably between −0.4 bar and −0.6 bar.

With regard to performing the dewatering step by mechanical pressing force and, optionally or in addition to this, with a gas flow, and with regard to the various configurations of apparatus for performing such a dewatering step, PCT/EP2005/050198 is hereby included in full in the disclosure content of this current application.

The mechanical pressing force is generated during the dewatering step by conveying the arrangement of structured mesh 13, tissue paper web 14 and felt 19 to a dewatering section 21 between a tensioned press belt 22 and a smooth surface 23, in which case press belt 22 acts on structured mesh 13 and felt 19 rests on smooth surface 23. Smooth surface 23 is thus formed by circumferential surface 23 of roller 24.

Dewatering section 21 is defined essentially by the wrap zone of press belt 22 around circumferential surface 23 of roller 24, whereby the wrap zone is defined by the distance between two deflector rollers 25 and 26. Press belt 22 is under a tension of at least 30 kN/m, preferably at least 60 kN/m or 80 kN/m, and has an open area of at least 25% and a contact area of at least 10% of its total area facing the upper skin. In this specific case, the press belt is constructed as a spiral link fabric and has an open area of between 51% and 62% and a contact area of between 38% and 49% of its total area facing the upper skin. With regard to the structure of the press belt, PCT/EP2005/050198 is hereby included in full in the disclosure content of this present application.

Tissue paper web 14 leaves dewatering section 21 with a dry content of between 25% and 55%. After this dewatering step tissue paper web 14 together with structured mesh 13 is conveyed in a further dewatering step through a press nip 27, whereby tissue paper web 14 in press nip 27 is arranged between structured mesh 13 and smooth roller surface 28 of a Yankee drying cylinder. Here press nip 27 is a press nip formed by Yankee drying cylinder 29 and shoe press 30.

On one side tissue paper web 14 lies with a relatively large area on circumferential surface 28 of Yankee drying cylinder 29, while on the other side tissue paper web 14 lies on structured mesh 13. Here depressed regions 16 and by comparison relatively raised regions 17 of structured mesh 13 are constructed and arranged in relation to each other such that pillow areas C' are essentially not pressed in press nip 27. The areas being 35% or less, in particular 25% or less of tissue paper web 14. By contrast, areas A' are pressed, as the result of which the strength of tissue paper web 14 is increased (FIG. 7).

Tissue paper web 114, known from the prior art, comes to rest on circumferential face 128 of the Yankee drying cylinder with a relatively small area compared to tissue paper web 14. The disadvantage of this is that tissue paper 114 might bum on the circumferential face, which is why the temperature of the Yankee cylinder has to be kept low in the methods known from the prior art. Consequently, a lower dry content is obtainable with the method known from the prior art (FIG. 8).

Between the two previously described dewatering steps it is possible to provide a further dewatering step which can be performed using an apparatus 31.

Provision can optionally be made for tissue paper web 14 to be conveyed together with structured mesh 13 around an evacuated roller before the web runs through press nip 27, in which case structured mesh 13 is arranged between tissue paper web 14 and the evacuated deflector roller (not illustrated).

From FIG. 10 it is evident that the gas flow can be generated in addition by an overpressure hood 31 arranged above structured mesh 13, whereby in this case the dewatering step is performed without mechanical pressing force, i.e. in contrast FIG. 9 no provision for a press belt 22 which wraps around roller 24 in some areas.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the production of a tissue paper web which is produced from a pulp suspension including fibers, the method comprising the steps of:

forming the pulp suspension at least partly by a pulp suspension fraction obtained through a treatment of old paper having a refining degree of less than 30° SR directly after a refiner, the tissue paper web being of such condition that a laboratory sheet according to TAPPI 205 SP 95 (Rapid Köthen), whose breaking length measured according to TAPPI 220 and TAPPI 494 is 4.0 km or more is produced therefrom; and producing said tissue paper web from said pulp suspension formed at least partly by said pulp suspension fraction obtained through said treatment of said old paper having said refining degree of less than 30° SR directly after said refiner, said tissue paper web having a breaking length measured according to TAPPI 220 and TAPPI 494 of 4.0 km or more.

2. The method of claim 1, wherein a laboratory sheet is produced from the pulp suspension according to TAPPI 205 SP 95 (Rapid Köthen) with a breaking length of 4.3 km or more measured according to TAPPI 220 and TAPPI 494.

3. The method of claim 2, wherein said pulp suspension has a refining degree of 28° SR or less.

4. The method of claim 3, wherein said refining degree is 25° SR or less.

5. The method of claim 1, wherein a fiber fraction of the pulp suspension is formed to a larger extent by fibers of the pulp suspension fraction obtained through the treatment of old paper than any other fibers.

6. The method of claim 5, wherein said fiber fraction of the pulp suspension is formed completely by the fibers of the pulp suspension fraction obtained through the treatment of old paper.

7. The method of claim 6, wherein the pulp suspension fraction obtained through the treatment of old paper includes de-inked pulp (DIP).

8. The method of claim 7, wherein the pulp suspension has an ash fraction of less than 4%.

9. The method of claim 8, wherein the pulp suspension has a fines fraction of less than 25%.

10. The method of claim 9, wherein the pulp suspension includes a suspension fraction which was produced from a low-consistency feed pulp suspension with a consistency of less than 5%.

11. The method of claim 10, wherein at least one of enzymes, agents for increasing the dry strength defining dry strength agents and agents for increasing the wet strength defining wet strength agents are added to the low-consistency feed pulp suspension.

12. The method of claim 11, wherein said dry strength agents include at least one of carbon methyl cellulose and starch.

13. The method of claim 11, wherein said wet strength agents include a water soluble polymer.

14. The method of claim 11, wherein said enzymes are added to a low-consistency feed suspension at a temperature in the range from 25° C. to 70° C.

15. The method of claim 14, wherein said temperature is between 30° C. and 60° C.

16. The method of claim 15, wherein said temperature is between 35° C. to 45° C.

17. The method of claim 14, wherein said enzymes are added to the low-consistency feed suspension with a pH-value in the range of 5 to 8.

18. The method of claim 17, wherein said pH-value is between 5.5 and 7.5.

19. The method of claim 18, wherein said pH-value is between 6.5 and 7.

20. The method of claim 14, wherein said enzymes are allowed to work for a period of 1 to 2 hours on the low-consistency feed suspension.

21. The method of claim 20, wherein said enzymes are added to the low-consistency feed pulp suspension prior to a refinement.

22. The method of claim 21, wherein said enzymes are added in a pulper.

23. The method of claim 1, wherein the pulp suspension includes a suspension fraction which was produced from a high-consistency feed pulp suspension having a consistency of 20% or more.

24. The method of claim 23, wherein said consistency is between 20% and 40%.

25. The method of claim 24, wherein said consistency is between 25% and 35%.

26. The method of claim 23, further comprising the step of concentrating a low-consistency feed to form said high-consistency feed suspension.

27. The method of claim 26, wherein said concentrating step is performed by a worm extruder.

28. The method of claim 23, further comprising the step of refining the high-consistency feed pulp suspension with a refining energy in a range of 150 kWh to 300 kWh per ton.

29. The method of claim 28, wherein said refining energy is in the range of 180 kWh to 250 kWh per ton.

30. The method of claim 28, wherein said refining of the high-consistency feed pulp suspension is done at a temperature of up to 80° C.

31. The method of claim 30, wherein said temperature is up to 40° C.

32. The method of claim 1, wherein the pulp suspension has a water retention value of 1.5 g/g or less measured according to TAPPI UM 256.

33. The method of claim 32, wherein said water retention value is 1.4 g/g or less.

34. The method of claim 1, further comprising the step of compressing the tissue paper web more intensively in some regions than in other regions.

35. The method of claim 34, wherein the tissue paper web is not compressed at all in the other regions.

36. The method of claim 1, further comprising the step of forming the tissue paper web from the pulp suspension on a 3-dimensionally structured mesh.

37. The method of claim 36, wherein a side of said structured mesh facing the tissue paper web includes a plurality of depressed regions and a plurality of raised regions relative to said depressed regions.

38. The method of claim 37, wherein the tissue paper web is formed in said depressed regions and said raised regions of said structured mesh.

39. The method of claim 36, wherein said structured mesh is one of a Through Air Drying (TAD) mesh and a Dimensionally Structured Paper (DSP) mesh.

40. The method of claim 1, further comprising the step of conveying the tissue paper web in a dewatering step between an upper 3-dimensionally structured permeable skin and a lower permeable skin, whereby pressure is exerted on said upper skin, the tissue paper web and said lower skin during said dewatering step along a dewatering section.

41. The method of claim 40, wherein a side of said upper skin facing the tissue paper web includes a plurality of depressed regions and a plurality of raised regions relative to said depressed regions.

42. The method of claim 41, wherein the tissue paper web is compressed less intensively in said depressed regions than in said raised regions.

43. The method of claim 41, wherein the tissue paper web is not compressed at all in said depressed regions.

44. The method of claim 40, wherein said upper structured permeable skin is one of a structured mesh, a TAD mesh and a DSP mesh, the lower permeable skin being a felt.

45. The method of claim 44, wherein said upper skin having a compressibility that is less than that of said lower skin.

46. The method of claim 45, wherein said upper skin has a dynamic rigidity (K), defined as a measure of compressibility of one of 3,000 N/mm and more than 3,000 N/mm.

47. The method of claim 45, wherein said lower skin has a dynamic rigidity (K), defined as a measure of compressibility of one of 100,000 N/mm and less than 100,000 N/mm.

48. The method of claim 47, wherein said dynamic rigidity is one of 90,000 N/mm and less than 90,000 N/mm.

49. The method of claim 48, wherein said dynamic rigidity is one of 70,000 N/mm and less than 70,000 N/mm.

50. The method of claim 45, wherein said lower skin has an elasticity also known as the G modulus of one of 2 $N/mm^2$ and more than 2 $N/mm^2$.

51. The method of claim 50, wherein said G modulus is one of 4 $N/mm^2$ and more than 4 $N/mm^2$.

52. The method of claim 40, wherein said lower skin has a permeability of one of 80 cfm, less than 80 cfm, 40 cfm, less than 40 cfm, 25 cfm and less than 25 cfm.

53. The method of claim 40, wherein in said dewatering step first said upper skin is charged with gas, then the tissue paper web and finally said lower skin.

54. The method of claim 40, wherein during said dewatering step the arrangement of said upper skin, the tissue paper web and said lower skin is conveyed at least in some areas along said dewatering section between a tensioned press belt and a smooth surface, said press belt acting on said upper skin and said lower skin in contact with said smooth surface.

55. The method of claim 54, wherein the arrangement of said upper skin, the tissue paper web and said lower skin is charged with a gas flow in at least some areas of said dewatering section.

56. The method of claim 55, wherein said gas flow through the tissue paper web amounts to approximately 150 $m^3$ per minute and meter length in said dewatering section.

57. The method of claim 55, wherein said gas flow is generated by a pressure hood arranged above said upper skin.

58. The method of claim 55, wherein said gas flow is generated by a suction zone in a roller.

59. The method of claim 58, wherein said suction zone has a length of at least one of between 200 mm and 2,500 mm, between 800 mm and 1,800 mm, and between 1,200 mm and 1,600 mm.

60. The method of claim 58, wherein said suction zone has a vacuum of at least one of between −0.2 bar and −0.8 bar, and between −0.4 bar and −0.6 bar.

61. The method of claim 54, wherein said press belt is under a tension of one of at least 30 kN/m, at least 60 kN/m and at least 80 kN/m.

62. The method of claim 54, wherein said press belt has a spiralized structure.

63. The method of claim 54, wherein said press belt has a woven structure.

64. The method of claim 54, wherein said press belt has an open area of at least 25% and a contact area of at least 10% of said press belt's total area facing said upper skin.

65. The method of claim 64, wherein said open area is between 75% and 85%, said contact area being between 15% and 25%.

66. The method of claim 64, wherein said open area is between 68% and 76%, said contact area being between 24% and 32%.

67. The method of claim 64, wherein said open area is between 51% and 62%, said contact area being between 38% and 49%.

68. The method of claim 64, wherein at least one of said open area is one of 50% and more than 50%, and said contact area is one of 50% and more than 50%.

69. The method of claim 54, wherein said smooth surface is formed by a circumferential surface of a roller.

70. The method of claim 54, wherein the tissue paper web leaves said dewatering section with a dry content of between 25% and 55%.

71. The method of claim 54, wherein said upper structured skin is used in said forming step of the tissue paper and said upper structured skin is used in said dewatering step.

72. The method of claim 71, wherein after said dewatering step the tissue paper web is conveyed together with said upper structured skin of the dewatering step through a press nip in a further dewatering step.

73. The method of claim 72, wherein the tissue paper web in said press nip is arranged between said upper structured skin and said lower skin and adjacent a smooth roller surface.

74. The method of claim 73, wherein said upper structured skin includes depressed areas and by comparison relatively raised areas constructed and arranged in relation to each other such that at least one of only 35% or less, and only 25% or less of the tissue paper web is pressed in said press nip.

75. The method of claim 74, wherein said press nip is a shoe press nip.

76. The method of claim 75, wherein said press nip is formed between a roller surface and a suction press roller.

77. The method of claim 76, wherein said roller surface is formed by a circumferential surface of a Yankee drying cylinder.

78. The method of claim 74, wherein the tissue paper web is conveyed together with said upper structured skin around an evacuated deflector roller, said upper structured skin being arranged between the tissue paper web and said evacuated deflector roller.

* * * * *